US009564110B2

(12) United States Patent
Steinberger

(10) Patent No.: US 9,564,110 B2
(45) Date of Patent: Feb. 7, 2017

(54) STRING CLAMPING SYSTEM FOR MUSICAL INSTRUMENTS

(71) Applicant: Richard Ned Steinberger, Nobleboro, ME (US)

(72) Inventor: Richard Ned Steinberger, Nobleboro, ME (US)

( * ) Notice: Subject to any disclaimer, the term of this patent is extended or adjusted under 35 U.S.C. 154(b) by 0 days.

(21) Appl. No.: 14/858,132

(22) Filed: Sep. 18, 2015

(65) Prior Publication Data

US 2016/0086586 A1 Mar. 24, 2016

Related U.S. Application Data

(60) Provisional application No. 62/053,367, filed on Sep. 22, 2014.

(51) Int. Cl.
*G10D 3/12* (2006.01)

(52) U.S. Cl.
CPC ..... *G10D 3/12* (2013.01)

(58) Field of Classification Search
CPC ..... G10D 3/14; G10D 3/12; G10D 3/143; G10D 3/10; G10D 1/08
USPC ..... 84/297 R, 297 S
See application file for complete search history.

(56) References Cited

U.S. PATENT DOCUMENTS 5,932,822 A * 8/1999 Bernstein ..... G10D 3/12 84/314 N

* cited by examiner

*Primary Examiner* — Kimberly Lockett
(74) *Attorney, Agent, or Firm* — Law Offices of Daniel A. Tesler, LLC

(57) ABSTRACT

A string clamping and tuning mechanism for stringed instruments is disclosed, where the string tension actuates one or more levers to generate two points of clamping force along the string. In a first embodiment, a single lever is used to generate two points of clamping force along the string. In a second embodiment, the clamping force is less concentrated at a first point of clamping force than a second point of clamping force to optimize the holding power of the mechanism. In a third embodiment, a second lever with a screw adjusted stop causes an increase or decrease in the tension in the string.

19 Claims, 4 Drawing Sheets

STRING CLAMPING SYSTEM FOR MUSICAL INSTRUMENTS

CROSS REFERENCE TO RELATED APPLICATIONS

This application claims the benefit of U.S. Provisional Patent Application No. 62/053,367 filed Sep. 22, 2014, which is hereby incorporated by reference in its entirety.

FIELD OF THE INVENTION

The present invention relates to musical instruments and, in particular, to stringed musical instruments.

BACKGROUND OF THE INVENTION

Over the years, many systems have been devised for securing and tensioning the strings of stringed musical instruments. Strings for musical instruments are usually provided with one ball end and one non-ball end.

One common tuning system in use today creates tension in the strings by wrapping the non-ball ends around tuning posts fixed at the head end of the instrument neck, which posts are tuned through a worm gear arrangement to create the required tension. The ball ends of the strings pass through openings in a tail piece, through which the balls or rings cannot pass. This system, while in common use, has stability problems because the worm gear drives needed to operate the tuning posts have backlash making precise tuning difficult, and also the strings can tighten around the posts after once being tightened, detuning the instrument.

In an alternative tuning system, the ball end of the string is held in a jaw, which is threaded to accept a screw that pulls the string taut. In this kind of tuning system, the non-ball end of the string is held in a clamp which ordinarily requires a tool of some sort to operate. To avoid the use of tools, this type of tuning system can alternatively hold the non-ball end of the string in a clamp that uses the tension of the string itself to provide a clamping force at a single point. By providing a clamping force at a single point, the clamping force is limited to the minimum force required to sever the string. For string players who pull aggressively on the strings when they play the instrument, the clamping force provided by a single point of clamping can be inadequate to hold the string, causing the instrument to detune.

The present invention permits the non-ball end of the string to be clamped without using tools, using the tension in the string itself to provide the clamping force in multiple locations along the string. In a second embodiment, the present invention distributes the clamping force over a wider area of the string at the point where the string is first clamped, as compared to the second point of clamping, to reduce the occurrence of the string severing at the first point. In a third embodiment, the present invention also provides an improved tuning system which has greater stability than the worm gear tuning posts of the past and a greater clamping force than the single point string tension clamps of the past without severing the strings.

Accordingly, it is an object of the present invention to provide a system for clamping the strings of a musical instrument that can be operated without tools and provides an adequate clamping force to withstand extreme bending of the strings without slipping. It is a further object of the invention to provide a stable tuning system for a stringed musical instrument that can be operated without tools and provides an adequate clamping force to withstand extreme bending of the strings without slipping.

BRIEF SUMMARY OF THE INVENTION

The present invention utilizes the tension in a string to provide more than one clamping force on the string, restraining the string from slipping longitudinally (and thereby altering the tension). The clamping forces are obtained by using one or more levers and two or more stops to convert string tension into clamping force.

The invention has application to all classes or families of stringed musical instruments, i.e., lutes (including violins), zithers, lyres, and harps. Such instruments include a plurality of strings under tension, the strings being anchored at each end. At one end of each string are means for adjusting the string tension, i.e., means for tuning the instrument.

For clarity, a representative structure of a musical instrument to which the invented clamping means is attached is shown in the drawings. While only a single type of instrument is shown in the drawings, those skilled in the art will readily appreciate how the mechanism described would be integrated into a particular instrument. The invention may be installed at either end of the string as is convenient in a particular situation.

In a first embodiment of the invention is a clamping mechanism to exert a clamping force on the non-ball end of a string in two locations. In the clamping mechanism, a single simple lever (one associated with each string) can rotate around an axis substantially perpendicular to the direction of string pull. The lever can also be slidably displaced in a direction substantially parallel to the direction of string pull, guided by a slotted opening in the lever. A first pinch pin passes through the slotted opening in the lever, allowing the lever to rotate around its axis and be displaced in a direction substantially parallel to direction of string pull. Each string passes over the end of its associated lever and through a downward opening in the lever. The downward opening is open to the slotted opening, allowing the string to pass between the first pinch pin and the wall of the downward opening. The string exits the downward opening and passes along the surface of the lever arm opposite the direction of string pull.

When the force of the string pull is exerted on the lever arm, the lever tends to both rotate on its axis and be displaced in the direction of string pull. The string passing between the first pinch pin and the wall of the downward opening is pinched, thereby anchoring the string and providing a first point of clamping force. The lever arm opposite the point of application of string pull is arranged to pinch the string against a fixed stop, thereby providing a second point of clamping force. Excess string may be cut off or inserted into an opening in the instrument.

In a second embodiment of the invention, the first point of clamping force distributes the clamping force over a wider area of the string, as compared to the second point of clamping force, thereby reducing the tendency of the string to be severed at the first point of clamping force.

In a third embodiment of the invention, string pull is exerted on the end of a lever as in the first embodiment or second embodiment, but a second lever, pivotally connected to the first lever and bearing against an adjustable stop, is used to provide the string pinching force. The first pinch pin passing through the slotted opening of the first lever is rigidly connected to the second lever, allowing the second lever to rotate and be displaced relative to the first lever. The second lever bears against an adjustable screw, thereby providing a means for adjusting string tension for tuning purposes.

DETAILED DESCRIPTION OF THE INVENTION

Figure 1:
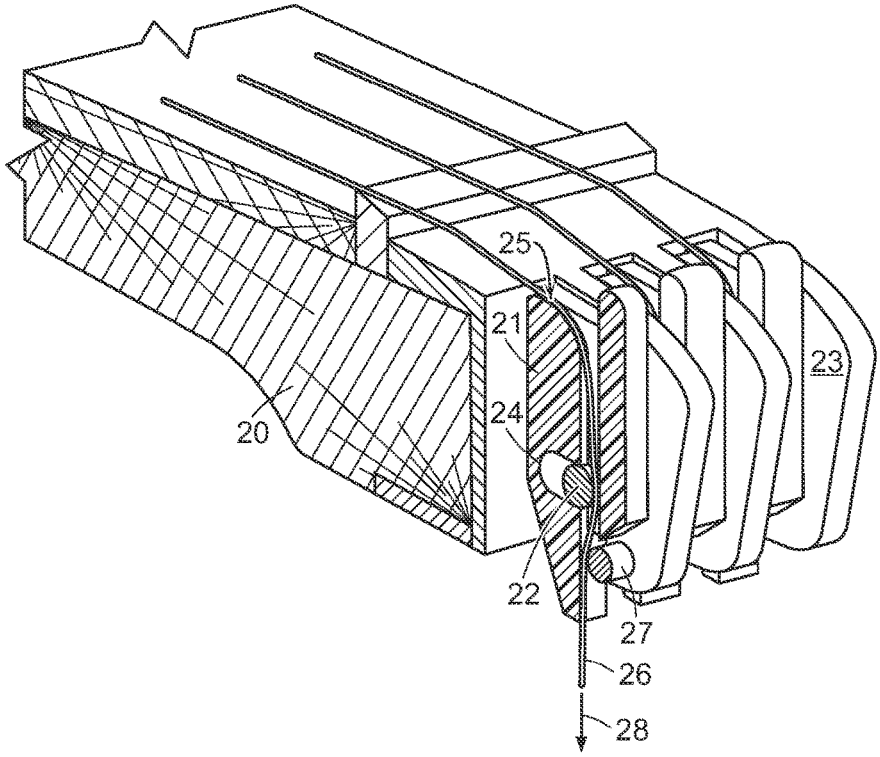
FIG. 1 is a partially sectioned trimetric view of a first embodiment of the invention, shown installed on a stringed instrument.
Figure 2:
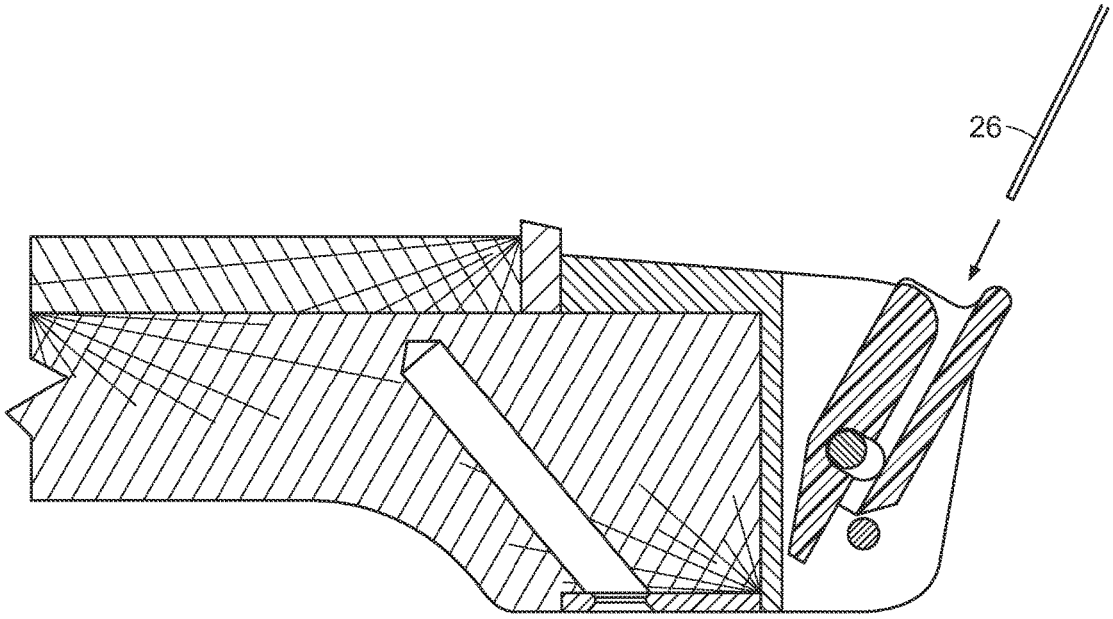
FIG. 2 is a side sectioned view of a first embodiment of the invention, configured to accept the non-ball end of a string.
Figure 3:
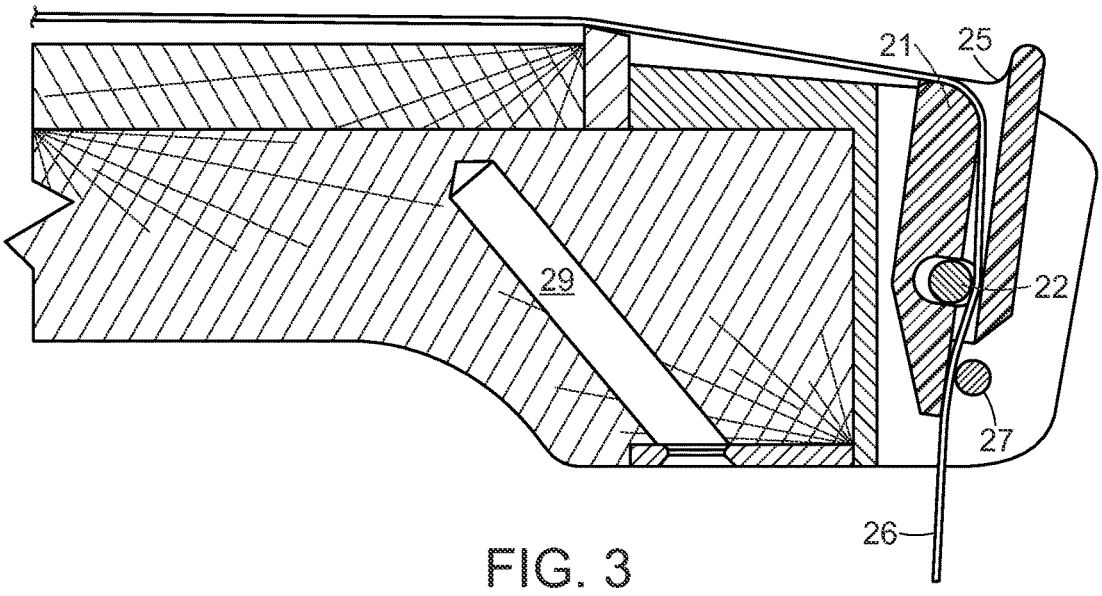
FIG. 3 is a side sectioned view of a first embodiment of the invention, shown applying multiple points of clamping force on the non-ball end of the string.

In FIGS. 1-3 is a first embodiment of the invention, a clamping mechanism to exert a clamping force on the non-ball end of a string 26 in two or more locations. FIG. 1 shows the invention mounted to the head of a stringed instrument 20. It is understood that the invention can be applied to either end of a stringed instrument.

The levers 21 are rotatable about the first pinch pins 22 which are fixed to the housing 23. The first pinch pins 22 pass through a slotted opening 24 in the lever, allowing the lever 21 to be slidably displaced in a direction substantially parallel to the direction of string pull. The levers contain a downward opening 25 for the non-ball end of a string 26 to pass that is substantially perpendicular to the direction of string pull. The downward opening 25 is open to the slotted opening 24, allowing the first pinch pin 22 to contact the interior wall of downward opening 25 that is oriented away from the direction of string pull. Lever rotation is limited by second pinch pin 27, also fixed to the housing 23. Elements 22 and 27 are called pinch pins because the string is pinched by it against the lever 21. It will be appreciated that the "pin" 27 need not be a distinct part, but could, as well, be integral with the structure of the housing.

The string 26 passes between the first pinch pin 22 and the wall of the downward opening 25 and then between lever 21 and second pinch pin 27. The non-ball end of the string 26 is then pulled taut in a generally downward direction (as denoted by the numeral 28 in FIG. 1). This motion of the string causes the lever to rotate about the first pinch pin 22 and pinch the string at second pinch pin 27. The motion of the string also causes the lever 21 to slide along the first pinch pin 22 through its slotted opening 24. The movement of the lever 21 relative to the first pinch pin 22 causes the first pinch pin to pinch the string 26 against the wall of downward opening 25.

The amount of pinch pressure relative to the string tension is determined by the ratio of the lever arms, in accordance with the elementary principles of mechanics. By appropriately setting the lever arm ratio, the amount of pinch pressure may be made sufficient to prevent string slippage, while at the same time not severing the string due to excess pressure. The relevant lever arms are 1) the distance from the contact between the string 26 and the lever 21 to the first pinch pin 22, and 2) the distance between the second pinch pin 27 and the first pinch pin 22. The pinch force can be varied by changing the distance between the first pinch pin 22 and the second pinch pin 27 or by changing the distance from the first pinch pin 22 to the point on the lever 21 where the string tension acts to cause the lever 21 to rotate about first pinch pin 22. The actual pinch force is influenced both by the lever arm ratio and the angle at which the string pulls in relation to lever 21.

FIGS. 2 and 3 illustrate the embodiment of FIG. 1 in various conditions. FIGS. 2 and 3 show in detail one string clamping mechanism of the first embodiment of the invention in FIG. 1. It is understood that the mechanism is replicated for each string of the instrument. FIG. 2 shows the clamping mechanism oriented to accept the non-ball end of a string 26. FIG. 3 shows the non-ball end of a string 26 held by a first clamping force exerted between first pinch pin 22 and the wall of downward opening 25 and a second clamping force exerted between second pinch pin 27 and lever 21. Excess string can either be cut off or tucked into opening 29.

Figure 4:
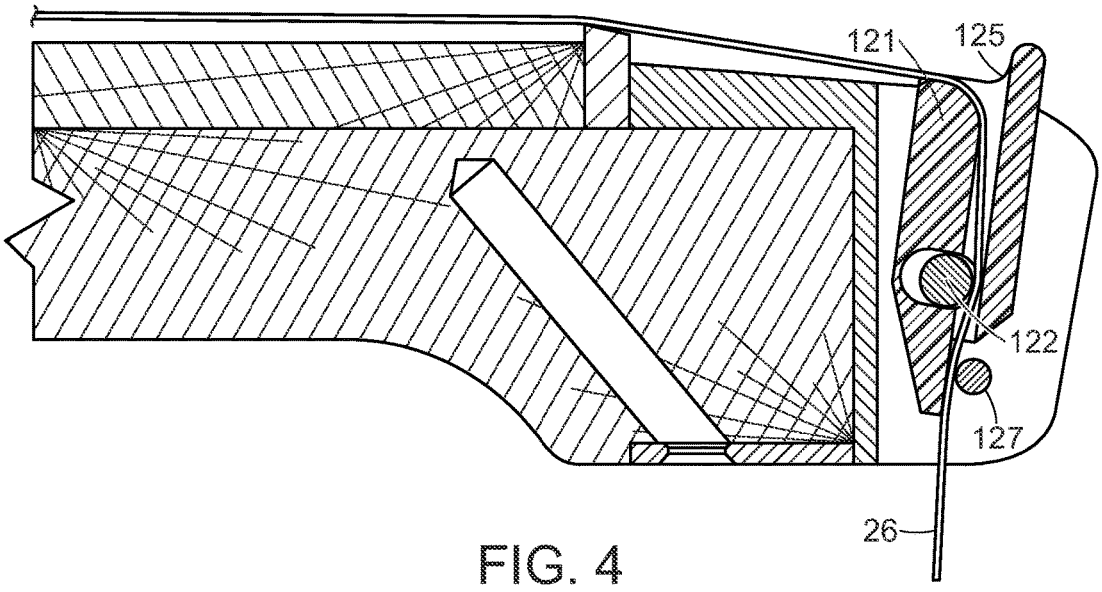
FIG. 4 is a side sectioned view of a second embodiment of the invention, shown applying multiple points of clamping force on the non-ball end of the string.

As seen in FIG. 4 is a second embodiment of the invention, a clamping mechanism to exert a different amount of clamping force on the non-ball end of a string 26 at each of two locations. The elements in the alternative embodiments which are substantially the same as the corresponding elements of the first embodiment described are identified with the same numeral. Elements which are similar (but not necessarily identical) in function are denoted by the same numeral plus 100.

FIG. 4 illustrates the use of a first pinch pin 122 of a larger diameter than second pinch pin 127. Increasing the diameter of first pinch pin 122 distributes the clamping force exerted on the string 26 over a broader area of the string between the first pinch pin 122 and the wall of downward opening 125. Reducing the diameter of second pinch pin 127 concentrates the clamping force to a smaller area of string 26 between the second pinch pin 127 and lever 121. By distributing the clamping force between the first pinch pin 122 and the wall of downward opening 125 over a broader area relative to the distribution of the clamping force on the string between the second pinch pin 127 and lever 121, the string 26 is less likely to be severed at the former. It is understood that the area over which the clamping force is distributed can be adjusted by means other than changing the diameter of the pins, such as through the use of different surface textures or materials or through the use of non-cylindrical pins.

Figure 5:
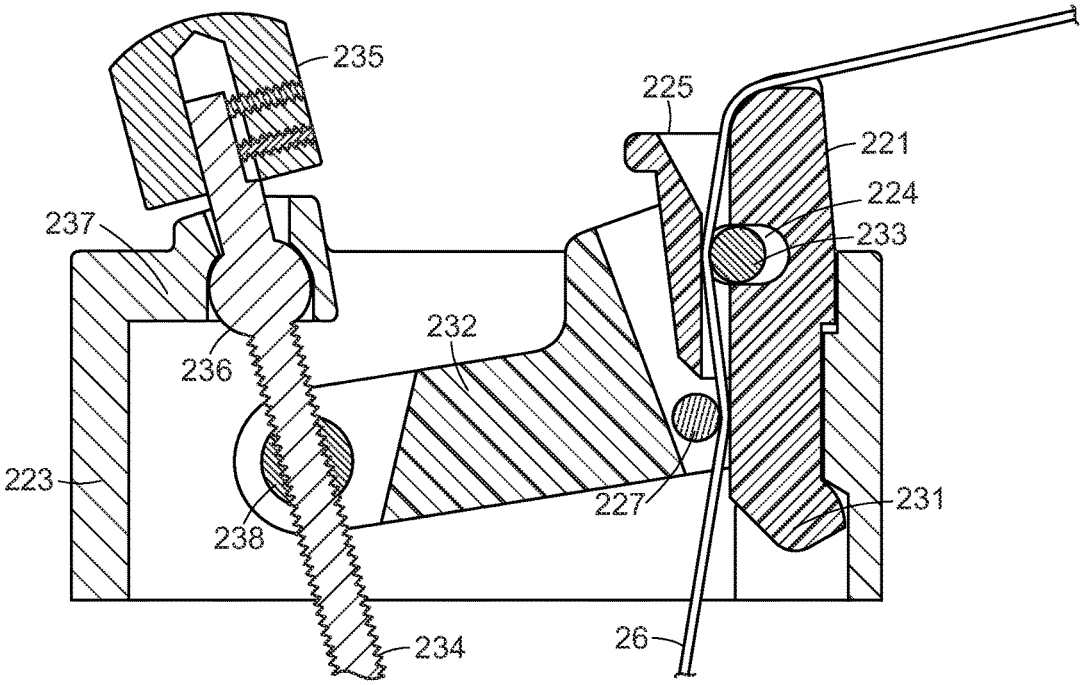
FIG. 5 is a side sectioned view of a third embodiment of the invention, sectioned down the center of the clamping mechanism, shown applying multiple points of clamping force on the non-ball end of the string.

FIG. 5 illustrates a third embodiment similar that further includes a second lever for additional mechanical advantage and a means for changing the tension in the strings for tuning purposes. Only a cross sectional view showing the details of one string mechanism is shown in FIG. 5, it being understood that the mechanism is replicated for each string of the instrument. According to the embodiment of FIG. 5, a housing 223 contains a plurality of levers 221, each corresponding to one of the strings 26 of the instrument. Each lever 221 rotates about a corresponding pivot pin 231.

Additionally, a second lever 232 (which has a clevis-like shape) rotates about a first pinch pin 233. The first pinch pins 233 are not attached to the housing 223, but rather attached to the respective lever 232. The first pinch pins 233 pass through a slotted opening 224 in the lever 221, allowing the lever 221 to rotate in a limited range about an axis substantially perpendicular to the direction of string pull. The levers 221 contain a downward opening 225 for the string 26 to pass that is substantially perpendicular to the direction of string pull. The downward opening 225 is open to the slotted opening 224, allowing the first pinch pin 233 to contact the interior wall of opening 225 that is oriented away from the direction of string pull. There is also a second pinch pin 227 attached to lever 232 that limits the rotation of lever 221.

Tension in string 26 causes the lever 221 to rotate about the pivot pin 231 and pinch the string at second pinch pin 227. The motion of the string also causes the first pinch pin 233 to slide through slotted opening 224, causing the first pinch pin 233 to pinch the string 26 against the wall of downward opening 225. The tension of string 26 can be adjusted using a threaded screw 234 with a removable head 235. A ball shaped section 236 on screw 234 engages a mating socket 237 in housing 223, permitting the screw to exert downward force on lever 232. Screw 234 passes through a threaded pin 238 in lever 232, the threaded pin being a loose fit in the lever, so as to allow alignment of the screw as lever 232 moves. Turning the screw 234 so as to move the second lever 232 downward rotates lever 221 counterclockwise so as to increase tension in the string 26. The positional relationship between the first pinch pin 233 and the second pinch pin 227 can be varied in the same manner as described in connection with FIGS. 1-3.

Figure 6:
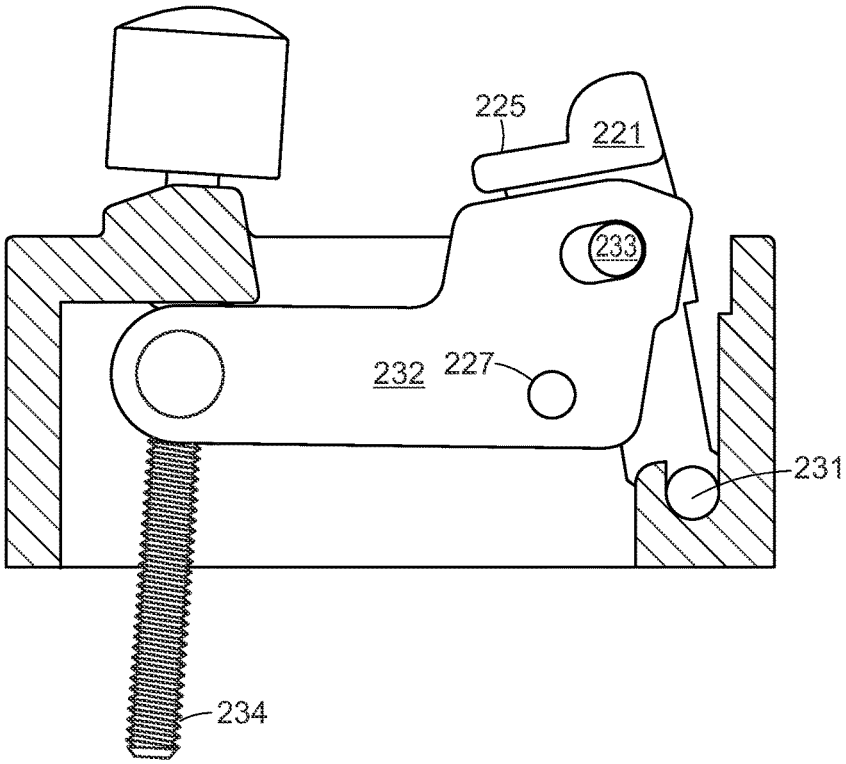
FIG. 6 is a side sectioned view of a third embodiment of the tuner, sectioned through the housing between two clamping mechanisms, configured to accept the non-ball end of a string.
Figure 7:
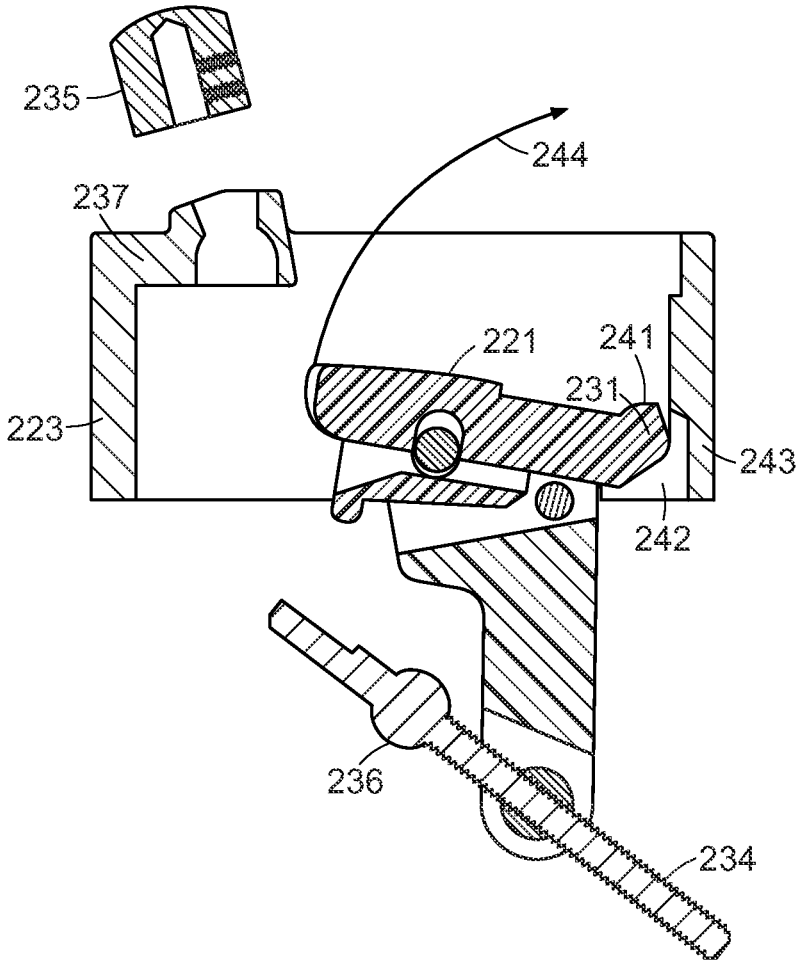
FIG. 7 is a side sectioned side view of a third embodiment of the invention, sectioned through the center of the clamping mechanism, shown with the levers being installed into the housing.

FIGS. 6 and 7 illustrate the embodiment of FIG. 5 in various conditions. FIG. 6 is a sectioned side view showing a side view of the mechanism where the housing between two adjacent clamping mechanisms is cut away. FIG. 6 shows the mechanism with the screw 234 turned to completely retract lever 232. In this condition, there is space between first pinch pin 233 and the wall of downward opening 225 and a space between second pinch pin 227 and lever 221 so as to permit a string to be easily threaded through the clamping mechanism. FIG. 6 also shows an alternate view of pivot pin 231.

FIG. 7 shows the method of installing the moveable components of the embodiment of FIG. 5 into the housing 223. Adjacent to pivot pin 231 is a protrusion 241 on lever 221. Pivot pin 231 engages a mating socket 242 in housing 223 that is rounded to correspond with the shape of the pivot pin 231. Mating socket 242 has a further opening 243 in the direction of the string pull from mating socket 242 that roughly corresponds to the shape of the protrusion 241.

The first step in the installation sequence is to place the pivot pin 231 into the mating socket 242 in housing 223. Once the pivot pin 231 is in contact with the mating socket 242, the lever assembly is rotated in the direction indicated by the arrow 244. As the assembly is rotated, the screw 234 is inserted through mating socket 237 in housing 223 until the ball shaped section 236 is in contact with mating socket 237. The removable head 235 is then reattached to screw 234, preventing the screw 234 from falling away from housing 223.

When the lever assembly is installed in the housing 223, the protrusion 241 engages its corresponding opening 243 in the housing 223. In the range of motion allowed by the screw 234, protrusion 241 prevents the lever 221 from movement other than in the axial direction about pivot pin 231.

Irrespective of the locations of the pinch pins, the pinching forces and the forces required to adjust the string tension may be set as desired by making the lever arms of appropriate length. The elementary principles of mechanics may be applied in making the calculations.

What has been described is a system for clamping the strings of a stringed musical instrument and for tuning the instrument. In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

The invention claimed is:

1. In a stringed musical instrument of the type having at least one string stretched between anchoring points, a string anchoring system which comprises:

a first lever rotatable about an axis normal to the direction of string pull and capable of being slidably displaced in the direction of said string pull, coupled to said string, tension in said string tending to cause said first lever to rotate and be displaced in the direction of string pull; and string clamping means actuated by rotation and displacement of said first lever responsive to tension in said string.

2. A string anchoring system as recited in claim 1 wherein said string clamping means comprises two pinch members against which said first lever bears, said string being pinched between said lever and said pinch members.

3. A string anchoring system as recited in claim 2, wherein said pinch members comprises a first pinch member, cylindrically shaped and of a first diameter, and a second pinch member, cylindrically shaped and of a second diameter.

4. A string anchoring system as recited in claim 3, wherein said first lever is rotatable about and capable of being slidably displaced relative to said first pinch member and said second pinch member is fixed relative to said first pinch member.

5. A string anchoring system as recited in claim 4, wherein said first pinch member is a larger diameter than said second pinch member.

6. A string anchoring system as recited in claim 5, wherein said pinch members are carried by a second lever, said second lever being rotatably and slidably coupled to said first lever, the rotation of said second lever being limited by a stop.

7. A string anchoring system as recited in claim 6, wherein said stop is positionally adjustable to change the tension in said string.

8. A string anchoring system as recited in claim 7, wherein said stringed musical instrument contains an opening to insert the excess of said string extending beyond said string clamping means.

9. In a stringed musical instrument, of the type having at least one string stretched between first and second anchoring points, a string anchoring system which comprises:

a housing attached to said instrument;

a first lever coupled to said housing for rotation around an axis normal to the length of said string, said string being partially bent around said lever whereby tension in said string will tend to cause rotation of said lever;

a second lever rotatably and slidably coupled to said first lever;

a first stop attached to said second lever with respect to said first lever, said string passing between said first lever and said first stop;

a second stop attached to said second lever with respect to said first lever, said string passing between said first lever and second stop; and a third stop attached to said housing and limiting the motion of said second lever with respect to said housing.

10. In a string anchoring system as recited in claim 9 wherein the position of said third stop with respect to said housing is adjustable.

11. In a string anchoring system as recited in claim 10 wherein said third stop is comprised of screw means threadedly coupled to said second lever and bearing against said housing.

12. In a string anchoring system as recited in claim 11 wherein said first lever rotates about a pivot point fixed to said housing.

13. In a string anchoring system as recited in claim 12 wherein said first lever rotates about a pivot pin containing a protrusion substantially parallel to said length of string, said pivot pin bearing against said housing and said protrusion engaging an opening in said housing of substantially the same shape as said protrusion and oriented substantially parallel to said length of string.

14. In a string anchoring system as recited in claim 13 wherein said second lever is rotatably and slidably coupled to said first lever by means of a slotted opening in said first lever with an axis oriented in a direction normal to said length of string and oblong in a direction substantially parallel to the direction of said length of string, and said first stop passing through said slotted opening and fixed to said second lever.

15. In a string anchoring system as recited in claim 14 wherein said first lever contains an opening in a radial direction from said pivot pin and said opening communicating with said slotted opening.

16. A string anchoring system as recited in claim 15, wherein said first stop is cylindrically shaped and of a first diameter, and said second stop is cylindrically shaped and of a second diameter.

17. A string anchoring system as recited in claim 16, wherein said first stop is of a larger diameter than said second stop.

18. A string anchoring system as recited in claim 17, wherein said stringed musical instrument contains an opening to insert the excess of said string extending beyond said second stop.

19. A string anchoring system as recited in claim 17, wherein said housing contains an opening to insert the excess of said string extending beyond said second stop.

* * * * *